US009810086B2

(12) United States Patent
Correia et al.

(10) Patent No.: US 9,810,086 B2
(45) Date of Patent: Nov. 7, 2017

(54) ASYMMETRIC RADIAL SPLINE SEAL FOR A GAS TURBINE ENGINE

(75) Inventors: Victor Hugo Silva Correia, Milton Mills, NH (US); Christopher Michael Ceglio, Salem, MA (US); David Scott Stapleton, Boston, MA (US)

(73) Assignee: General Electric Company, Schenectady, NY (US)

( * ) Notice: Subject to any disclaimer, the term of this patent is extended or adjusted under 35 U.S.C. 154(b) by 840 days.

(21) Appl. No.: 13/443,947

(22) Filed: Apr. 11, 2012

(65) Prior Publication Data

US 2013/0115065 A1 May 9, 2013

Related U.S. Application Data

(60) Provisional application No. 61/556,270, filed on Nov. 6, 2011.

(51) Int. Cl.
*F01D 9/04* (2006.01)
*F01D 11/00* (2006.01)

(52) U.S. Cl.
CPC ..... *F01D 11/005* (2013.01); *F01D 9/04* (2013.01); *F05D 2240/11* (2013.01); *F05D 2240/57* (2013.01); *F05D 2240/59* (2013.01)

(58) Field of Classification Search
CPC ..... F05B 2240/11; F05B 2240/57; F05B 2240/572; F01D 11/005; F01D 11/006; F01D 11/008; F01D 9/02; F01D 9/04; F16J 15/002; F16J 15/02
USPC ..... 415/134, 136, 137, 138, 139, 170.1, 415/173.1, 182.1, 196, 214.1
See application file for complete search history.

(56) References Cited

U.S. PATENT DOCUMENTS 5,074,748 A 12/1991 Hagle
5,154,577 A 10/1992 Kellock et al.
(Continued)

FOREIGN PATENT DOCUMENTS

EP 1586743 A1 10/2005

OTHER PUBLICATIONS

Search Report and Written Opinion from corresponding PCT Application No. PCT/US2012/052185, dated May 31, 2013.
(Continued)

*Primary Examiner* — Christopher Verdier
*Assistant Examiner* — Christopher R Legendre
(74) *Attorney, Agent, or Firm* — General Electric Company; William Scott Andes

(57) ABSTRACT

A shroud apparatus for a gas turbine engine includes: an annular shroud segment having an arcuate bottom wall defining an arcuate inner flowpath surface, spaced-apart forward and aft walls extending radially outward from the bottom wall, and spaced-apart side walls extending radially outward from the bottom wall and between the forward and aft walls, each side wall defining an end face which includes: an axial slot extending in a generally axial direction along the end face; a first radial slot extending in a generally radial direction along the end face, and intersecting the axial slot; an axial spline seal received in the axial slot; and a first radial spline seal having an L-shape with radial and axial legs, the radial leg being substantially longer than the axial leg, wherein the radial leg is received in the first radial slot, and the axial leg is received in the axial slot.

8 Claims, 4 Drawing Sheets

(56) References Cited

U.S. PATENT DOCUMENTS 5,641,267 A * 6/1997 Proctor ..... F01D 11/08 415/173.1
5,655,876 A 8/1997 Rock et al.
5,868,398 A 2/1999 Maier
6,162,014 A 12/2000 Bagepalli et al.
6,464,232 B1 * 10/2002 Marchi ..... F01D 11/005 277/630
6,503,051 B2 1/2003 Predmore
6,814,538 B2 * 11/2004 Thompson ..... 415/116
7,201,559 B2 * 4/2007 Gendraud ..... F01D 11/005 277/641
7,513,740 B1 * 4/2009 Hervy et al. ..... 415/173.1
7,600,967 B2 * 10/2009 Pezzetti, Jr. ..... F01D 11/005 415/115
7,625,174 B2 12/2009 Drerup et al.
7,631,879 B2 12/2009 Diantonio
7,993,097 B2 * 8/2011 Amiot et al. ..... 415/116
8,360,716 B2 * 1/2013 Bergman ..... F01D 9/02 415/190
8,534,675 B2 * 9/2013 Heinz-Schwarzmaier F01D 11/005 277/650
2005/0232752 A1 10/2005 Meisels
2007/0025837 A1 2/2007 Pezzetti, Jr. et al.
2007/0210536 A1 9/2007 Paauwe
2007/0212214 A1 9/2007 Paauwe
2011/0236199 A1 * 9/2011 Bergman et al. ..... 415/208.1
2012/0141257 A1 * 6/2012 Berche ..... F01D 11/005 415/177
2013/0115065 A1 * 5/2013 Correia et al. ..... 415/182.1

OTHER PUBLICATIONS

Unofficial English Translation of Japanese Office Action issued in connection with corresponding JP Application No. 2014539946 dated Mar. 8, 2016.

* cited by examiner

ASYMMETRIC RADIAL SPLINE SEAL FOR A GAS TURBINE ENGINE

CROSS-REFERENCE TO RELATED APPLICATIONS

This Application claims the benefit of Provisional Patent Application No. 61/556,270, filed on Nov. 6, 2011.

STATEMENT REGARDING FEDERALLY SPONSORED RESEARCH AND DEVELOPMENT

The U.S. Government may have certain rights in this invention pursuant to contract number W911W6-07-2-0002 awarded by the Department of the Army.

BACKGROUND OF THE INVENTION

This invention relates generally to gas turbine engines, and more particularly to apparatus and methods for sealing turbine shrouds in such engines.

A typical gas turbine engine includes a turbomachinery core having a compressor, a combustor, and a turbine in serial flow relationship. The core is operable in a known manner to generate a primary gas flow. The turbine includes one or more rotors which extract energy from the primary gas flow. Each rotor comprises an annular array of blades or buckets carried by a rotating disk. The flowpath through the rotor is defined in part by a shroud, which is a stationary structure which circumscribes the tips of the blades or buckets. These components operate in an extremely high temperature environment, and must be cooled by air flow to ensure adequate service life. Typically, the air used for cooling is extracted (bled) from the compressor. Bleed air usage negatively impacts specific fuel consumption ("SFC") and should generally be minimized The turbine shroud typically comprises a ring or array of side-by-side arcuate segments. Leakage between adjacent segments must be minimized in order to meet engine performance requirements while providing adequate cooling to the hardware. This is often accomplished using spline seals which are small metallic strips that bridge the gaps between adjacent shroud segments. Multiple spline seals are often positioned in axial and radial directions, in intersecting slots. In order to reduce leakage at the interface of two perpendicular seals, a seal with an L-shape (an "L-seal") is sometimes used in order to dead-end chute flow in the seal slots. The L-seals are small and not easily assembled, and increase the number of parts needed for the shroud assembly.

Accordingly, there is a need for a spline seal which prevents leakage at the intersection of shroud seal slots and which is easy to assemble.

BRIEF DESCRIPTION OF THE INVENTION

This need is addressed by the present invention, which provides an asymmetric L-seal.

According to one aspect of the invention, a shroud apparatus for a gas turbine engine includes: an annular shroud segment having an arcuate bottom wall defining an arcuate inner flowpath surface, spaced-apart forward and aft walls extending radially outward from the bottom wall, and spaced-apart side walls extending radially outward from the bottom wall and between the forward and aft walls, each side wall defining an end face which includes: an axial slot extending in a generally axial direction along the end face; a first radial slot extending in a generally radial direction along the end face, and intersecting the axial slot; an axial spline seal received in the axial slot; and a first radial spline seal having an L-shape with radial and axial legs, the radial leg being substantially longer than the axial leg, wherein the radial leg is received in the first radial slot, and the axial leg is received in the axial slot.

According to another aspect of the invention a shroud apparatus for a gas turbine engine includes: an annular array of arcuate shroud segments, each of the shroud segments having an arcuate bottom wall defining an arcuate inner flowpath surface, spaced-apart forward and aft walls extending radially outward from the bottom wall, and spaced-apart side walls extending radially outward from the bottom wall and between the forward and aft walls, each side wall defining an end face, the shroud segments arranged such that a gap is present between the end faces of adjacent shroud segments; wherein each end face includes: an axial slot extending in a generally axial direction along the end face; a first radial slot extending in a generally radial direction along the end face, and intersecting the axial slot; a plurality of axial spline seals, each axial spline seal received in the axial slots of each pair of adjacent end faces; a plurality of first radial spline seals, each first radial spline seal having an L-shape with radial and axial legs, the radial leg being substantially longer than the axial leg, wherein the radial leg is received in the first radial slots of each pair of adjacent end faces, and the axial leg is received in the axial slots of each pair of adjacent end faces.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
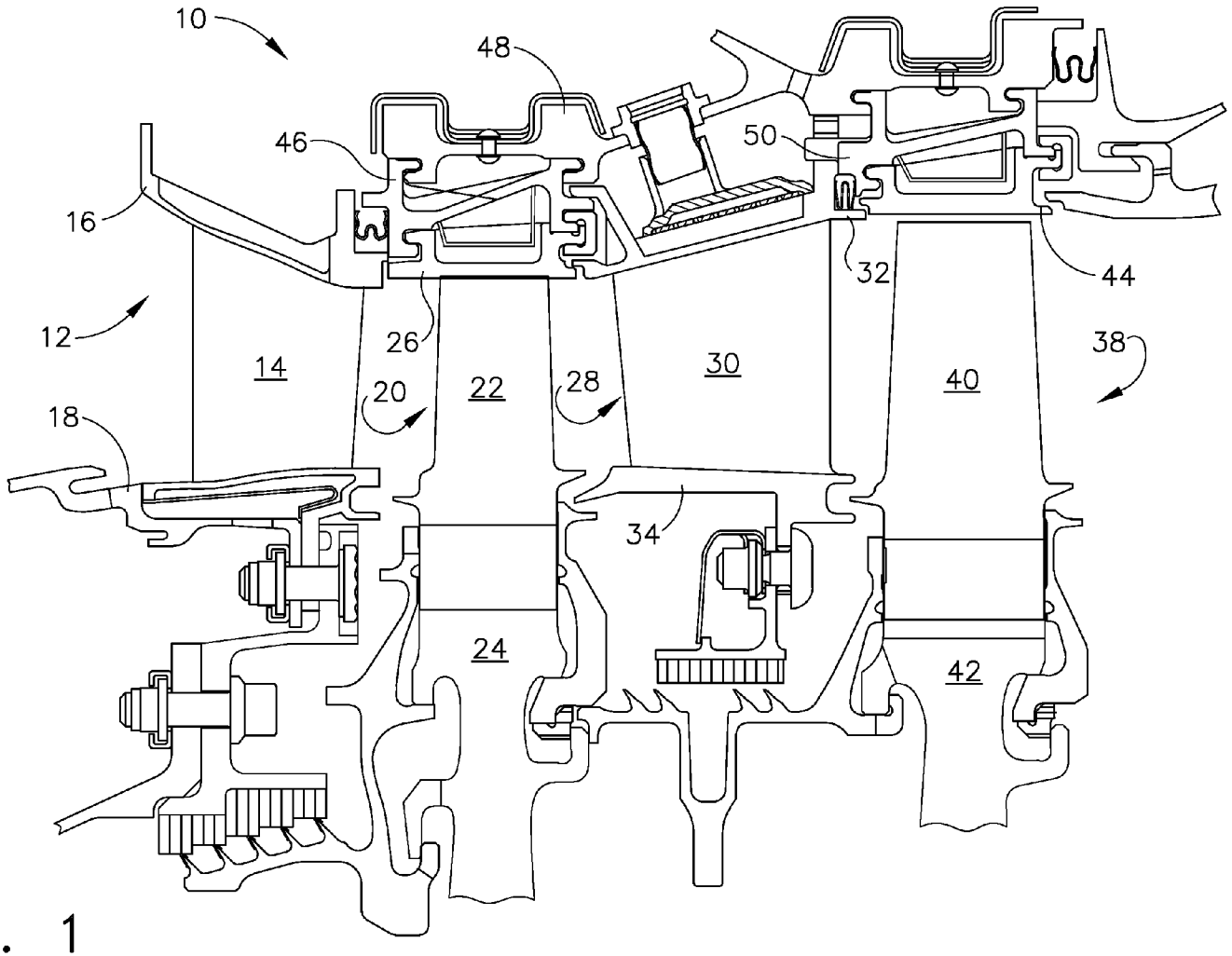
FIG. 1 is a schematic cross-sectional view of a portion of a turbine section of a gas turbine engine, incorporating a spline seal apparatus constructed in accordance with an aspect of the present invention.

Referring to the drawings wherein identical reference numerals denote the same elements throughout the various views, FIG. 1 depicts a portion of a gas generator turbine 10, which is part of a gas turbine engine of a known type. The function of the gas generator turbine 10 is to extract energy from high-temperature, pressurized combustion gases from an upstream combustor (not shown) and to convert the energy to mechanical work, in a known manner. The gas generator turbine 10 drives an upstream compressor (not shown) through a shaft so as to supply pressurized air to the combustor.

In the illustrated example, the engine is a turboshaft engine and a work turbine (also called a power turbine) would be located downstream of the gas generator turbine 10 and coupled to an output shaft. However, the principles described herein are equally applicable to turboprop, turbojet, and turbofan engines, as well as turbine engines used for other vehicles or in stationary applications.

The gas generator turbine 10 includes a first stage nozzle 12 which comprises a plurality of circumferentially spaced airfoil-shaped hollow first stage vanes 14 that are supported between an arcuate, segmented first stage outer band 16 and an arcuate, segmented first stage inner band 18. The first stage vanes 14, first stage outer band 16 and first stage inner band 18 are arranged into a plurality of circumferentially adjoining nozzle segments that collectively form a complete 360° assembly. The first stage outer and inner bands 16 and 18 define the outer and inner radial flowpath boundaries, respectively, for the hot gas stream flowing through the first stage nozzle 12. The first stage vanes 14 are configured so as to optimally direct the combustion gases to a first stage rotor 20.

The first stage rotor 20 includes an array of airfoil-shaped first stage turbine blades 22 extending outwardly from a first stage disk 24 that rotates about the centerline axis of the engine. A ring of arcuate first stage shroud segments 26 is arranged so as to closely surround the first stage turbine blades 22 and thereby define the outer radial flowpath boundary for the hot gas stream flowing through the first stage rotor 20.

A second stage nozzle 28 is positioned downstream of the first stage rotor 20, and comprises a plurality of circumferentially spaced airfoil-shaped hollow second stage vanes 30 that are supported between an arcuate, segmented second stage outer band 32 and an arcuate, segmented second stage inner band 34. The second stage vanes 30, second stage outer band 32 and second stage inner band 34 are arranged into a plurality of circumferentially adjoining nozzle segments that collectively form a complete 360° assembly. The second stage outer and inner bands 32 and 34 define the outer and inner radial flowpath boundaries, respectively, for the hot gas stream flowing through the second stage turbine nozzle 34. The second stage vanes 30 are configured so as to optimally direct the combustion gases to a second stage rotor 38.

The second stage rotor 38 includes a radial array of airfoil-shaped second stage turbine blades 40 extending radially outwardly from a second stage disk 42 that rotates about the centerline axis of the engine. A ring of arcuate second stage shroud segments 44 is arranged so as to closely surround the second stage turbine blades 40 and thereby define the outer radial flowpath boundary for the hot gas stream flowing through the second stage rotor 38.

The first stage shroud segments 26 are supported by an array of arcuate first stage shroud hangers 46 that are in turn carried by an arcuate shroud support 48, for example using the illustrated hooks, rails, and C-clips in a known manner. The second stage shroud segments 44 are supported by an array of arcuate second stage shroud hangers 50 that are in turn carried by the shroud support 48, for example using the illustrated hooks, rails, and C-clips in a known manner.

Figure 2:
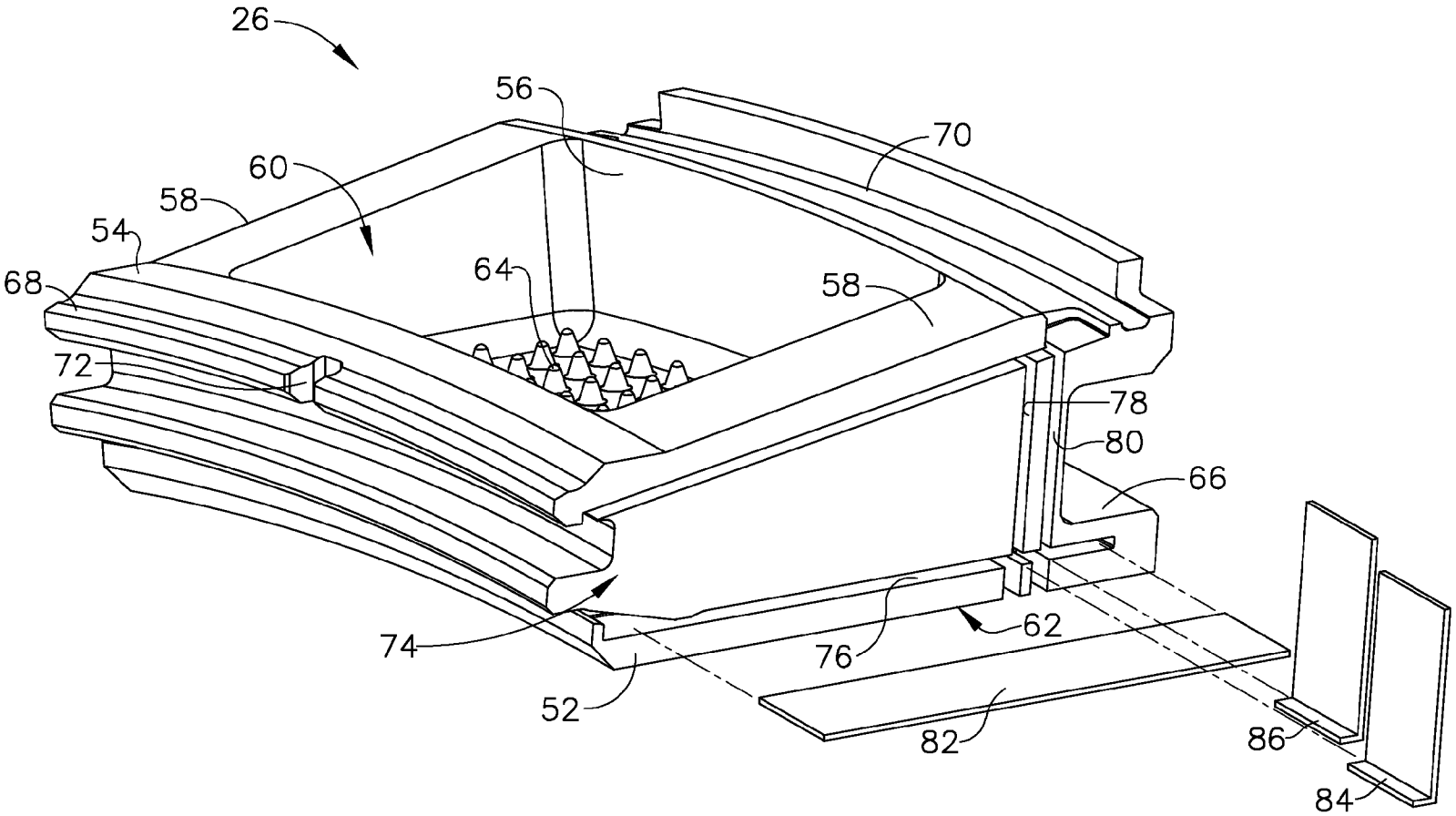
FIG. 2 is a schematic perspective view of a shroud seen in FIG. 1.
Figure 3:
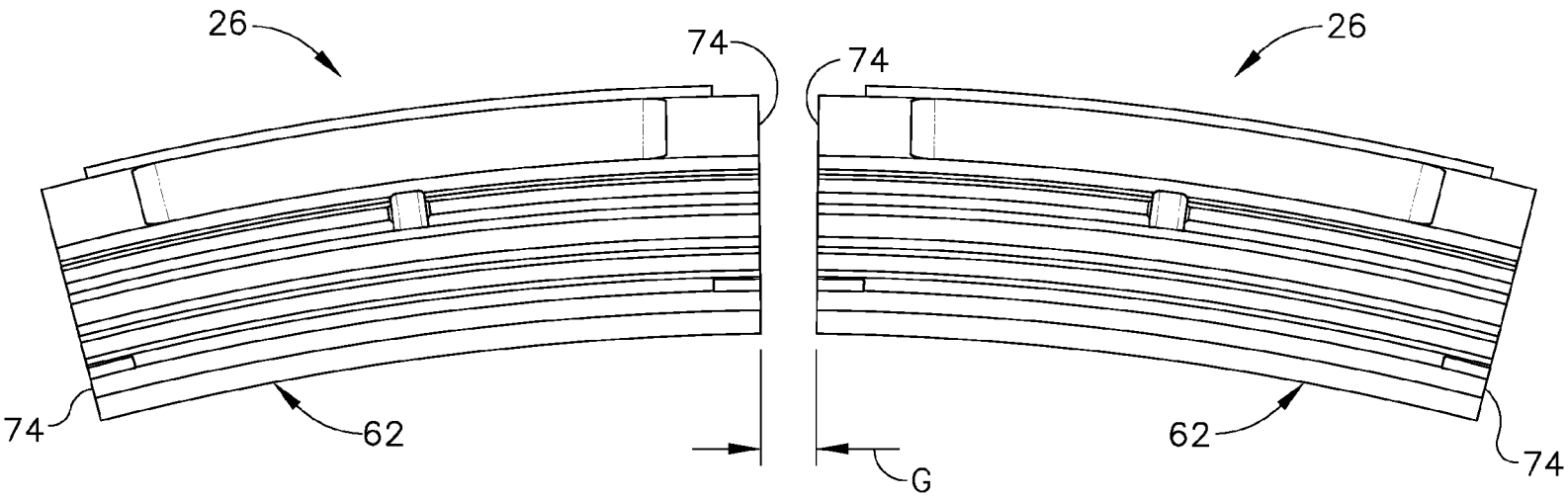
FIG. 3 is a front elevation view of a portion of the turbine section shown in FIG. 1.

FIGS. 2 and 3 illustrate the first stage shroud segments 26 in more detail. It will be understood that, while the first stage shroud segments 26 and the second stage shroud segments 44 are not identical, they are similar in design. The principles of the present invention as applied to the first stage shroud segments 26 are representative of how spline seals may be implemented for the second stage shroud segments 44 as well.

Each shroud segment 26 has an arcuate bottom wall 52. Extending radially outward from the bottom wall 52 opposed forward and aft walls 54 and 56, and a pair of spaced-apart side walls 58 which extend axially between the forward and aft walls 54 and 56. Collectively, the bottom wall 52, forward and aft walls 54 and 56, and the side walls 58 define an open shroud cavity 60.

The radially inboard face of the bottom wall 52 defines an arcuate radially inner flowpath surface 62. The outboard face of the bottom wall 52 may include protruding pins, ribs, fins, and/or turbulence promoters ("turbulators") to enhance heat transfer. Small tapered pin fins 64 are shown in FIG. 2. The bottom wall 52 extends axially aft past the aft wall 56 to define an aft flange or overhang 66. An arcuate forward rail 68 extends axially forward from the forward wall 54, and an arcuate aft rail 70 extends axially aft past the aft wall 56. In the illustrated example a notch 72 is formed in the forward rail 68 to receive a pin (not shown) or other anti-rotation feature.

The first stage shroud segments 26 include opposed end faces 74 (also commonly referred to as "slash" faces), defined by the side walls 58. The end faces 74 may lie in a plane parallel to the centerline axis of the engine, referred to as a "radial plane", or they may be slightly offset from the radial plane, or they may be oriented so that they are at an acute angle to such a radial plane. When assembled into a complete ring, end gaps are present between the end faces 74 of adjacent shroud segments 26, as shown by arrow "G" in FIG. 3.

Each end face 74 has seal slots formed into it to receive spline seals. In the illustrated example, there is a generally axially-extending axial slot 76 formed along the bottom wall 52, a generally-radially-extending forward radial slot 78 formed at the axial location of the aft wall 56, and a generally-radially-extending aft radial slot 80 disposed just aft of the forward radial slot 78.

Spline seals are inserted into the seal slots 76, 78, and 80. These take the form of thin, flat strips of metal or other suitable material and are sized to be received in the seal slots 76, 78, and 80 and have a width sufficient to span across the gap G between adjacent shroud segments 26 when installed in the engine. More specifically, a straight axial spline seal 82 is inserted into the axial seal slot 76. A forward radial spline seal 84 is inserted into the forward radial seal slot 78, and an aft radial spline seal 86 is inserted into the aft radial seal slot 80.

Figure 4:
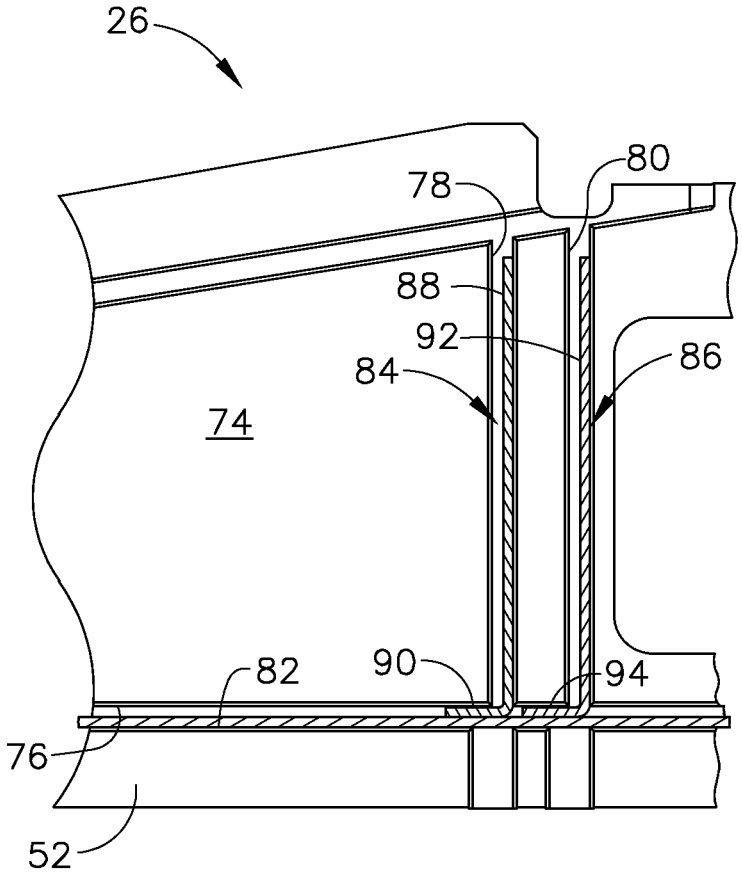
FIG. 4 is a side elevational view of a portion of a shroud segment with spline seals disposed therein.

As best seen in FIG. 4, the forward radial spline seal 84 (which may also be referred to as an "L-seal") is generally "L"-shaped in cross-section, with a radial leg 88 and an axial leg 90. In the illustrated example, the length of the radial leg 88 is about two to three times the length of the axial leg 90. The radial leg 88 is received in the forward radial seal slot 78, and the axial leg 90 is received in the axial seal slot 76, such that it lies against the axial seal 82. The aft radial spline seal 86 (which may also be referred to as an "L-seal") is generally "L"-shaped in cross-section, with a radial leg 92 and an axial leg 94. In the illustrated example, the length of the radial leg 92 is about two to three times the length of the axial leg 94. The radial leg 92 is received in the aft radial seal slot 80, and the axial leg 94 is received in the axial seal slot 76, such that it lies against the axial seal 82.

Each of the seals 82, 84, and 86 spans the gap "G" and is received in the corresponding slots in an adjacent shroud segment 26. The spline seals span the gaps between shroud segments 18. The radial spline seals 84 and 86 are effective in combination with the axial seal 82 to stop chute flow between the shroud segments 26.

The present invention has several advantages over conventional L-seals. The asymmetric L-seal combines the leakage reduction benefits of L-seal configurations with the ease of assembly of a non-L-seal design. For designs that require an L-seal to meet performance, the fewer number of seals, along with the fact that the asymmetric L-seal is larger and easier to handle than a typical L-seal, is an improvement over the current alternative at assembly. For configurations that currently do not have an L-seal, the asymmetric L-seal is expected to reduce leakage without complicating assembly.

The foregoing has described a spline seal apparatus for a gas turbine engine. While specific embodiments of the present invention have been described, it will be apparent to those skilled in the art that various modifications thereto can be made without departing from the spirit and scope of the invention. Accordingly, the foregoing description of the preferred embodiment of the invention and the best mode for practicing the invention are provided for the purpose of illustration only and not for the purpose of limitation.

What is claimed is:

1. A shroud apparatus for a gas turbine engine, comprising:

an annular shroud segment having an arcuate bottom wall defining an arcuate inner flowpath surface, spaced-apart forward and aft walls extending radially outward from the bottom wall, and spaced-apart side walls extending radially outward from the bottom wall and between the forward and aft walls, each side wall defining an end face;

wherein each end face includes:

an axial slot extending in a generally axial direction along the end face;

a first radial slot extending in a generally radial direction along the end face, and intersecting the axial slot;

an axial spline seal received in the axial slot;

a first radial spline seal having an L-shape with radial and axial legs, the radial leg being two to three times longer than the axial leg, wherein the radial leg is received in the first radial slot, and the axial leg is received in the axial slot and lies against the axial spline seal;

a second radial slot extending in a generally radial direction along the end face, the second radial slot intersecting the axial slot; and a second radial spline seal having an L-shape with radial and axial les, the radial leg being two to three times longer than the axial leg, wherein the radial leg is received in the second radial slot, and the axial leg is received in the axial slot and lies against the axial spline seal.

2. The shroud apparatus of claim 1 wherein each axial slot extends along the bottom wall.

3. The shroud apparatus of claim 1 wherein each first radial slot extends along the aft wall.

4. The shroud apparatus of claim 1 wherein each second radial slot extends along the aft wall.

5. The apparatus of claim 1 wherein the bottom wail extends axially aft past the aft wall to define an aft overhang.

6. The apparatus of claim 1 wherein an arcuate forward rail extends axially forward from the forward wall.

7. The apparatus of claim 1 wherein an arcuate aft rail extends axially aft from the aft wall.

8. A shroud apparatus for a gas turbine engine, comprising:

an annular array of arcuate shroud segments, each shroud segment having:

an arcuate bottom wall defining an arcuate inner flowpath surface, spaced-apart forward and aft walls extending radially outward from the bottom wall, and spaced-apart side walls extending radially outward from the bottom wall and between the forward and aft walls, each side wall defining an end face;

the shroud segments arranged such that a gap is present between the end faces of adjacent shroud segments;

wherein each end face includes:

an axial slot extending in a generally axial direction along the end face;

a first radial slot extending in a generally radial direction along the end face, and intersecting the axial slot;

a plurality of axial spline seals, each axial spline seal received in the axial slots of each pair of adjacent end faces; and a plurality of first radial spline seals, each first radial spline seal having an L-shape with radial and axial legs, each radial leg of the first radial spline seals being two to three times longer than each axial leg of the first radial spline seals, wherein for each pair of adjacent end faces:

the radial leg of the first radial spline seal is received in the first radial slots, and the axial leg of the first radial spline seal is received in the axial slots and lies against the axial spline seal;

wherein each end face further comprises:

a second radial slot extending in a generally radial direction along the end face, the second radial slot intersecting the axial slot; and a plurality of second radial spline seals, each second radial spline seal having an L-shape with radial and axial legs, each radial leg of the second radial spline seals being two to three times longer than each axial leg of the second radial spline seals, wherein for each pair of adjacent end faces:

the radial leg of the second radial spline seal is received in the second radial slots, and the axial leg of the second radial spline seal is received in the axial slots and lies against the axial spline seal.

* * * * *